United States Patent [19]

Moberg

[11] 4,319,776

[45] Mar. 16, 1982

[54] SEAL

[75] Inventor: Sigurd M. Moberg, Etlan, Va.

[73] Assignee: E. J. Brooks Company, Newark, N.J.

[21] Appl. No.: 38,324

[22] Filed: May 11, 1979

[51] Int. Cl.[3] ..... B65D 33/34

[52] U.S. Cl. ..... 292/322

[58] Field of Search ..... 292/307, 316, 317, 318, 292/319, 320, 321, 322; 24/16 PB

[56] References Cited

U.S. PATENT DOCUMENTS

| | | | |
|---|---|---|---|
| 3,466,077 | 9/1969 | Moberg | 292/322 |
| 3,717,369 | 2/1973 | Stoffel et al. | 292/322 X |
| 3,854,482 | 12/1974 | Laugherty et al. | 292/322 X |
| 3,954,294 | 5/1976 | Iwamoto et al. | 292/318 |

FOREIGN PATENT DOCUMENTS

| | | | |
|---|---|---|---|
| 2342681 | 3/1974 | Fed. Rep. of Germany | 292/320 |

*Primary Examiner*—Richard E. Moore
*Attorney, Agent, or Firm*—Robert E. Ross

[57] ABSTRACT

A security seal formed of a single piece of molded plastic in which a socket member and a stud member intended for locking engagement are disposed on the ends of legs so mounted on a base that the seal may be closed by squeezing the legs together with the fingers of one hand so that the socket and stud lock together.

An additional bowed member extends between the legs, which flexes when the legs are squeezed together, providing additional spring back force to cause the stud and socket to separate if not completely locked together. The additional bowed member also provides additional aligning force to insure that the stud and socket are properly aligned for engagement when squeezed together.

6 Claims, 4 Drawing Figures

SEAL

BACKGROUND OF THE INVENTION

There is a continuing need for improved security seals that are economical to manufacture, that provide effective security and are easy to use. Seals known in the prior art have intended to be capable of rapid assembly by the use of one hand only; however, during such use the components often become mis-aligned because of the lateral flexibility of the component parts, slowing down the seal attaching operation. In high volume operations, the increased time necessary to attach such seals can be significant.

It has also been found that such seals are occasionally only partially closed during assembly. The locking components generally comprise a stud and a socket. Occasionally the stud and socket do not become completely engaged, allowing the seal to be easily opened and re-closed by an interloper.

SUMMARY OF THE INVENTION

This invention provides a security seal formed of a single piece of molded plastic in which a socket member and a stud member intended for locking engagement are disposed on the ends of legs so mounted on a base that the seal may be closed by squeezing the legs together with the fingers of one hand so that the socket and stud lock together.

An additional bowed member extends between the legs, which flexes when the legs are squeezed together, providing additional spring back force to cause the stud and socket to separate if not completely locked together. The additional bowed member also provides additional aligning force to insure that the stud and socket are properly aligned for engagement when squeezed together.

DESCRIPTION OF THE ILLUSTRATED EMBODIMENT

Figure 1:
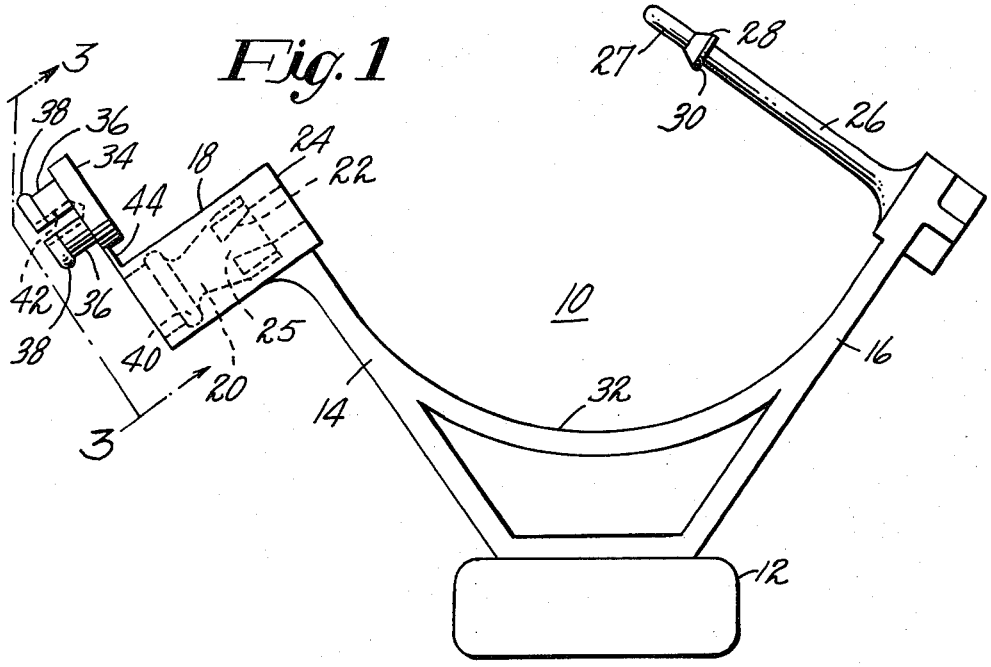
FIG. 1 is a view in elevation of a seal embodying the features of the invention, the seal being in the open position.
Figure 2:
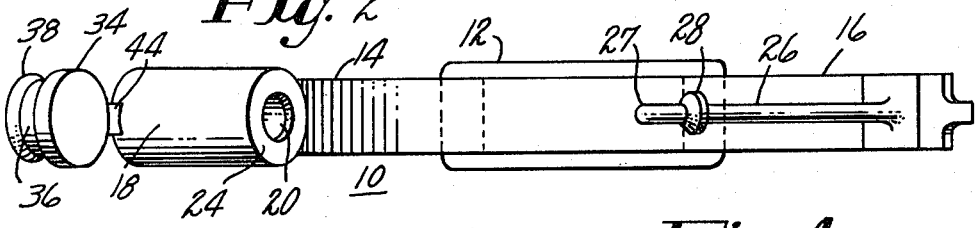
FIG. 2 is a view of the seal of FIG. 1 as seen from the top.
Figure 3:
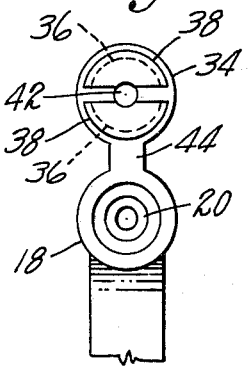
FIG. 3 is a view in section taken on line 3—3 of FIG. 1.
Figure 4:
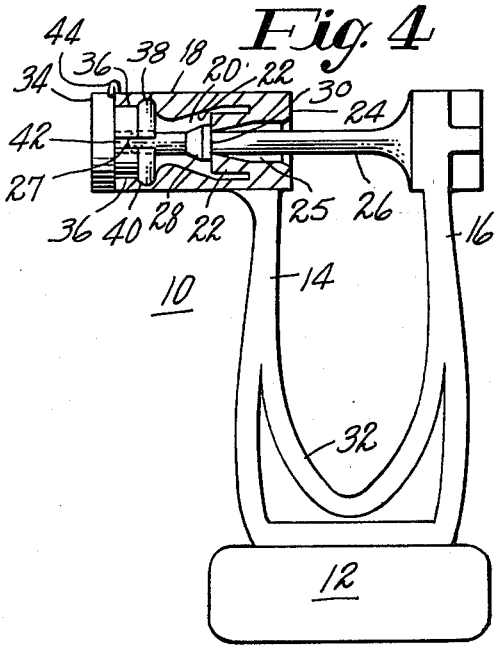
FIG. 4 is a view in elevation, partly in section, of the seal in the closed position.

Referring to the drawing, there is illustrated a seal 10, which comprises a base portion 12 and a pair of flexible legs 14 and 16 extending upwardly from the base and diverging from each other.

Disposed on the remote end of the leg 14 is a housing 18 which is open at each end with an internal cavity 20, the axis of which is substantially perpendicular to the direction of leg 14.

Disposed within the cavity 20 are a plurality of flexible fingers 22 which are recessed inside the front end 24 of the housing, and extend away from the opening at said front end, forming a socket 25.

Disposed on the remote end of the leg 16 is an elongated stud 26 which extends generally in a direction perpendicular to the direction of the leg 16, and is provided with an enlarged head 28 positioned rearwardly from the extreme end 27, said enlarged head having a rearwardly facing shoulder 30.

The parts of the device are so positioned and dimensioned that when the two legs 14 and 16 are squeezed together, the end of the stud 26 will enter the socket 25 of the housing by way of the front end of the housing so that the head 28 passes between the flexible fingers 22 and the fingers snap behind the shoulder 30.

In the manual assembly and closing of seals of this type, it has been found that on some occasions the stud and socket may not become completely engaged. Since the plastic hinge providing the resilience between the stud and socket is relatively weak, it does not provide sufficient re-opening force to pull the stud out of the socket, even though the stud and socket are not fully engaged. The seal, therefore, appears to be secure, even though it is not.

To avoid this possibility, an additional spring 32 is provided, which extends between the legs 14 and 16 at approximately the mid-point thereof and is bowed downwardly toward the base 12.

As the legs 14 and 16 are squeezed together, the spring 32 is flexed downwardly toward the base. The flexed spring therefore provides a substantial opening force to the legs. Hence if the seal is not completely closed, so that the head 28 is not seated behind the resilient fingers in the housing, but is merely frictionally gripped between said fingers, the opening force provided by the flexed spring 32 is strong enough to pull the stud out of the housing when the seal is released from the manual squeezing force.

The spring 32 also provides additional resistance to sideways motion of the stud relative to the housing when the parts are squeezed together, to insure that the stud approaches the housing in alignment with the housing aperture.

In the illustrated embodiment the stud is elongated, so that it may be passed through a hasp, or other closure fastener, and protrude therefrom far enough to make assembly with the socket housing convenient. The flexibility of the stud also allows relative movement between the end of the stud and the socket, if necessary, to accomodate installations in which the closure fastener has poorly aligned openings or in which the space in which the seal is to be positioned is restricted.

The configuration of stud head 28 and locking fingers 22 is by way of example only, since other forms of locking stud and socket combinations are known in the art, and may be used without departing from the scope of the invention.

In the illustrated embodiment, the rear end of the housing 18 may be closed by a plug 34 having resilient locking legs 36 with external shoulders 38 which snap into non-removable engagement with an internal peripheral recess 40 in the housing.

The legs 38 of the plug 34 form a central cavity 42 which is dimensioned to receive the extreme end 27 of the stud when the seal is closed. The cavity 42 and the stud end 27 are so dimensioned that the stud end 27 fits tightly into the cavity 42 when the seal is closed thereby preventing the legs 36 from flexing inwardly, so that the plug 34 is locked in the housing, and cannot be removed without leaving evidence of tampering.

The plug 34 may be molded as an integral part of the seal 10, connected thereto by a hinge 44, for assembly into the housing by the manufacturer before the seal is shipped to the user.

The plug can also be molded separately, and then assembled into the housing. In either case for additional security, the plug may be secured in the housing by adhesives or by heat sealing.

The herein illustrated and described plug and socket configuration does not form part of the present invention, but is described and claimed in a copending application of Richard S. Guiler, Ser. No. 038,325, filed May 11, 1979 and now U.S. Pat. No. 4,229,031, and assigned to the same assignee as this application.

Configurations other than the spring 32 may be provided to impart the desired opening force to the seal. The additional opening force is particularly desirable in embodiments of the invention which utilize the herein illustrated socket and plug, because of the additional frictional resistance caused by the entry of the extreme end 27 of the stud into the cavity 42.

In the preferred embodiment of the invention the seal 10 may be molded of a single piece of plastic such as polypropylene; however, other materials and other methods of manufacture may be used without departing from the scope of the invention.

Since certain changes or modifications obvious to one skilled in the art may be made in the specific embodiment of the inventive concept herein illustrated, it is intended that all matter contained herein be interpreted in an illustrative and not a limiting sense.

I claim:

1. A one-piece plastic seal, comprising a medial portion, a pair of arms extending from the medial portion, the ends of said arms being spaced apart and having cooperating engaging means on the ends thereof for locking engagement with each other, at least one of said arms being flexible so that the arms can be manually flexed together, said arms being so positioned and dimensioned that when flexed together, the cooperating means enter into engagement with each other, and having spring-back force when flexed together sufficient to cause said arms to separate unless said cooperating means is fully engaged, said spring-back force being provided in part by flexible means joining the arms in spaced relation to the medial portion.

2. A seal as set out in claim 1 in which said arms and said flexible means have appreciable width such that when the arms are manually flexed together, the width of the arms and said flexible means tend to prevent sideways motion of the ends of said arms out of the desired plane of movement so that the cooperating engaging means are in alignment with each other.

3. A one-piece plastic seal, comprising a pair of arms joined together at one end and extending therefrom, a socket on the remote end of one arm and a stud on the remote end of the other arm, said stud and socket being dimensioned and positioned for locking engagement when the arms are manually squeezed together, and a flexible spring member extending between the arms and being connected thereto in spaced relation to the said one end thereof, said flexible spring member being bowed so that it flexes when the arms are squeezed together and thereby provides a substantial opening force to the arms.

4. A seal as set out in claim 3 in which said socket comprises a hollow elongated body having internal flexible fingers and said stud has a flange forming a locking shoulder spaced from the end thereof, said stud being adapted to enter the socket between the flexible fingers so that said flange passes beyond said fingers into locking engagement therewith.

5. A seal, comprising a pair of flexible arms joined at one end and extending therefrom in diverging relationship, one arm having an elongated stud member extending therefrom in the same general direction as that of the other arm, said other arm having a socket disposed therein, said socket having an aperture the axis of which extends in the same general direction as that of said one arm, said stud having a locking flange disposed thereon in spaced relation to the extreme end thereof, and said socket being positioned to receive the stud when the arms are manually squeezed together and having internal flexible fingers dimensioned to be sprung apart by the passage therethrough of the locking flange and to snap behind the fully inserted flange to prevent withdrawal of the stud and flexible spring means joined to the legs in spaced relation to the said one ends, said spring means being bowed so that it is flexed when the arms are flexed together to provide a substantial opening force to the arms to cause them to separate when released in the event that the flange is not fully inserted into locked relation with the flexible fingers.

6. A one-piece plastic seal comprising a base, a pair of arms extending from the base, the ends of the arms being spaced apart and having cooperating engaging means on the ends thereof for locking engagement with each other, at least one arm being flexible about its junction with the base so that the arms can be manually moved together into locking engagement, and a separate spring means associated with said arms so as to provide additional spring-back force to cause said arms to separate unless the cooperating engaging means are in the fully locked condition.

* * * * *